US007948462B2

(12) United States Patent
Tseng

(10) Patent No.: US 7,948,462 B2
(45) Date of Patent: May 24, 2011

(54) METHOD FOR DRIVING LCD MONITOR FOR DISPLAYING A PLURALITY OF FRAME DATA DURING A PLURALITY OF FRAME DURATIONS

(75) Inventor: Ching-Wu Tseng, Taipei County (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 686 days.

(21) Appl. No.: 11/625,334

(22) Filed: Jan. 21, 2007

(65) Prior Publication Data

US 2008/0094332 A1 Apr. 24, 2008

(30) Foreign Application Priority Data

Oct. 24, 2006 (TW) ..... 95139117 A

(51) Int. Cl.
*G09G 3/36* (2006.01)

(52) U.S. Cl. ..... 345/96; 345/209

(58) Field of Classification Search ..... 345/89, 345/96, 209

See application file for complete search history.

(56) References Cited

U.S. PATENT DOCUMENTS

| | | | | |
|---|---|---|---|---|
| 6,144,353 | A * | 11/2000 | McKnight | 345/94 |
| 6,940,481 | B2 * | 9/2005 | Konno et al. | 345/96 |
| 2002/0154085 | A1 * | 10/2002 | Kim | 345/96 |
| 2005/0093806 | A1 * | 5/2005 | Hosotani | 345/96 |
| 2005/0110809 | A1 * | 5/2005 | Tung et al. | 345/690 |
| 2005/0162365 | A1 * | 7/2005 | Aoki | 345/96 |
| 2007/0013631 | A1 * | 1/2007 | Yang | 345/96 |
| 2007/0024560 | A1 * | 2/2007 | Kim et al. | 345/94 |

* cited by examiner

*Primary Examiner* — Chanh Nguyen
*Assistant Examiner* — Kwang-Su Yang
(74) *Attorney, Agent, or Firm* — Winston Hsu; Scott Margo

(57) ABSTRACT

A method for driving an LCD monitor includes providing a common-voltage signal having a level conversion during each frame duration, dividing each frame duration into a first sub-frame duration and a second sub-frame duration according to a position having the level conversion of the common-voltage signal, driving a first set of pixel units during the first sub-frame duration according to a level of the common-voltage signal within the first sub-frame duration, and driving a second set of pixel units during the second sub-frame duration according to a level of the common-voltage signal within the second sub-frame duration.

7 Claims, 12 Drawing Sheets

METHOD FOR DRIVING LCD MONITOR FOR DISPLAYING A PLURALITY OF FRAME DATA DURING A PLURALITY OF FRAME DURATIONS

BACKGROUND OF THE INVENTION

1. Field of the Invention

The present invention relates to a method for driving an LCD monitor, and more particularly, to a method for obtaining image quality of specified driving methods (such as a line inversion driving method) with power consumption of a frame inversion driving method.

2. Description of the Prior Art

The advantages of a liquid crystal display (LCD) include lighter weight, less electrical consumption, and less radiation contamination. Thus, the LCD monitors have been widely applied to various portable information products, such as notebooks, PDAs, etc. In an LCD monitor, incident light produces different polarization or refraction effects when the alignment of liquid crystal molecules is altered. The transmission of the incident light is affected by the liquid crystal molecules, and thus magnitude of the light emitting out of liquid crystal molecules varies. The LCD monitor utilizes the characteristics of the liquid crystal molecules to control the corresponding light transmittance and produces gorgeous images according to different magnitudes of red, blue, and green light.

Please refer to FIG. 1, which illustrates a schematic diagram of a prior art thin film transistor (TFT) LCD monitor 10. The LCD monitor 10 includes an LCD panel 100, a control circuit 102, a data-line-signal output circuit 104, a scan-line-signal output circuit 106, and a voltage generator 108. The LCD panel 100 is constructed by two parallel substrates, and the liquid crystal molecules are filled up between these two substrates. A plurality of data lines 110, a plurality of scan lines 112 that are perpendicular to the data lines 110, and a plurality of TFTs 114 are positioned on one of the substrates. There is a common electrode installed on another substrate, and the voltage generator 108 is electrically connected to the common electrode for outputting a common voltage Vcom via the common electrode. Please note that only four TFTs 114 are shown in FIG. 1 for clarity. Actually, the LCD panel 100 has one TFT 114 installed in each intersection of the data lines 110 and scan lines 112. In other words, the TFTs 114 are arranged in a matrix format on the LCD panel 100. The data lines 110 correspond to different columns, and the scan lines 112 correspond to different rows. The LCD monitor 10 uses a specific column and a specific row to locate the associated TFT 114 that corresponds to a pixel. In addition, the two parallel substrates of the LCD panel 100 filled up with liquid crystal molecules can be considered as an equivalent capacitor 116.

The operation of the prior art LCD monitor 10 is described as follows. When the control circuit 102 receives a horizontal synchronization signal 118 and a vertical synchronization signal 120, the control circuit 102 generates corresponding control signals respectively inputted into the data-line-signal output circuit 104 and the scan-line-signal output circuit 106. The data-line-signal output circuit 104 and the scan-line-signal output circuit 106 then generate input signals to the LCD panel 100 for turning on the corresponding TFTs 114 and changing the alignment of liquid crystal molecules and light transmittance, so that a voltage difference can be kept by the equivalent capacitors 116 and image data 122 can be displayed in the LCD panel 100. For example, the scan-line-signal output circuit 106 outputs a pulse to the scan line 112 for turning on the TFT 114. Therefore, the voltage of the input signal generated by the data-line-signal output circuit 104 is inputted into the equivalent capacitor 116 through the data line 110 and the TFT 114. The voltage difference kept by the equivalent capacitor 116 can then adjust a corresponding gray level of the related pixel through affecting the related alignment of liquid crystal molecules positioned between the two parallel substrates. In addition, the data-line-signal output circuit 104 generates the input signals, and magnitude of each input signal inputted to the data line 110 is corresponding to different gray levels.

If the LCD monitor 10 continuously uses a positive voltage to drive the liquid crystal molecules, the liquid crystal molecules will not quickly change a corresponding alignment according to the applied voltages as before. Thus, the incident light will not produce accurate polarization or refraction, and the quality of images displayed on the LCD monitor 10 deteriorates. Similarly, if the LCD monitor 10 continuously uses a negative voltage to drive the liquid crystal molecules, the liquid crystal molecules will not quickly change a corresponding alignment according to the applied voltages as before. Thus, the incident light will not produce accurate polarization or refraction, and the quality of images displayed on the LCD monitor 10 deteriorates. In order to protect the liquid crystal molecules from being irregular, the LCD monitor 10 must alternately use positive and the negative voltages to drive the liquid crystal molecules. In addition, not only does the LCD panel 100 have the equivalent capacitors 116, but the related circuit will also have some parasite capacitors owing to its intrinsic structure. When the same image is displayed on the LCD panel 100 for a long time, the parasite capacitors will be charged to generate a residual image effect. The residual image with regard to the parasite capacitors will further distort the following images displayed on the same LCD panel 100. Therefore, the LCD monitor 10 must alternately use the positive and the negative voltage to drive the liquid crystal molecules for eliminating the undesired residual image effect. Please refer to FIG. 2 and FIG. 3, FIG. 2 and FIG. 3 are schematic diagrams of a prior art frame inversion driving method. Blocks 20 and 30 show polarities of pixels in the same part of two successive image frames. Comparing the blocks 20 and 30, when the LCD panel 100 is driven by the frame inversion driving method, polarities of pixels in a frame are uniform and change to opposite polarities as a frame changes.

However, when the LCD monitor 10 alternately uses the positive and negative voltage to drive the liquid crystal molecules, the image displayed will flicker owing to a voltage offset generated by the TFT 114. The reason is described as follows. Firstly, as shown in FIG. 1, the gray level variation of each pixel is generated by the equivalent capacitor 116 with different voltages, which is driven by the corresponding TFT 114. Practically, the TFT 114 is also affected by spurious elements, such as off resistances (Roff) and gate-drain capacitors (Cgd), so that the voltages outputted to the equivalent capacitor 116 are offset. For example, please refer to FIG. 4, which is an output voltage diagram of the data-line-signal output circuit 104 shown in FIG. 1. As with the voltages V0, V1, V2, V3, V4, V5, V6, V7, V8, V9 shown in FIG. 4, the data-line-signal output circuit 104 generates different voltages according to display data 122 for driving the TFTs 114 positioned on the LCD panel 100. However, when the thin film transistor 114 is turned on, the voltage difference between the input terminal and the output terminal of the TFT 114 is equal to a deviation Vd. Therefore, the actual values of voltages such as V20, V21, V22, V23, V24, V25, V26, V27, V28, V29 imposed on the LCD panel 100 are individually lower than the corresponding ideal values of voltages such as V0, V1, V2, V3, V4, V5, V6, V7, V8, V9. As mentioned above, the LCD monitor 10 alternatively uses the positive and negative voltages to drive each pixel on the LCD panel 100. In other words, the voltage outputted from the data-line-signal output circuit 104 has to be changed so that the voltage difference between the voltage outputted from the data-line-signal output circuit 104 and the common voltage Vcom generated by the voltage generator 108 has an alternating polarity. For example, the display data 122 indicates that a voltage difference V1−Vcom is required to drive one pixel, and the pixel will hold the voltage difference V1−Vcom during a predetermined interval. Because the pixel is alternatively driven with the positive and negative voltages, the positive voltage V1−Vcom and the negative voltage −(Vcom−V8) are alternatively imposed on the LCD panel 100. However, the actual voltage V21−Vcom is not equal to the voltage Vcom−V28 owing to the deviation Vd of the TFT 114. Therefore, when the pixel is alternatively driven with the positive voltage V21−Vcom and the negative voltage −(Vcom−V28), the pixel flickers because of an unstable gray level.

In order to solve the mentioned problem when the LCD monitor 10 alternatively uses the positive and negative voltages to drive the liquid crystal molecules, the LCD monitor 10 adopts different driving methods to eliminate the image flickers. Please refer to FIG. 5 to FIG. 6. FIG. 5 and FIG. 6 are diagrams of a prior art line inversion driving method. Blocks 50 and 60 show polarities of pixels in the same part of two successive image frames. Comparing the blocks 50 and 60, when the LCD panel 100 is driven by the line inversion driving method, polarities of pixels in a line are uniform and change to opposite polarities as a frame changes. Nevertheless, polarities of pixels in adjacent lines are opposite.

As the LCD panel is driven by the line inversion driving method, polarities of pixels in a line are uniform and change to opposite polarities as a frame changes, and polarities of pixels in adjacent lines are opposite. Hence, the line inversion driving method can eliminate image flickers along the vertical direction. Therefore, the line inversion driving method achieves better image quality than the frame inversion driving method. However, the line inversion driving method consumes more power than the frame inversion driving method does, so that applications of the line inversion driving method are limited, especially in portable electric devices.

SUMMARY OF THE INVENTION

It is therefore a primary objective of the claimed invention to provide a method for driving an LCD monitor.

According to the claimed invention, a method for driving a liquid crystal display (LCD) monitor for displaying a plurality of frame data during a plurality of frame durations comprises providing a common-voltage signal having a level conversion during each frame duration, dividing each frame duration into a first sub-frame duration and a second sub-frame duration according to a position having the level conversion of the common-voltage signal, driving a first set of pixel units during the first sub-frame duration according to a level of the common-voltage signal within the first sub-frame duration, and driving a second set of pixel units during the second sub-frame duration according to a level of the common-voltage signal within the second sub-frame duration.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
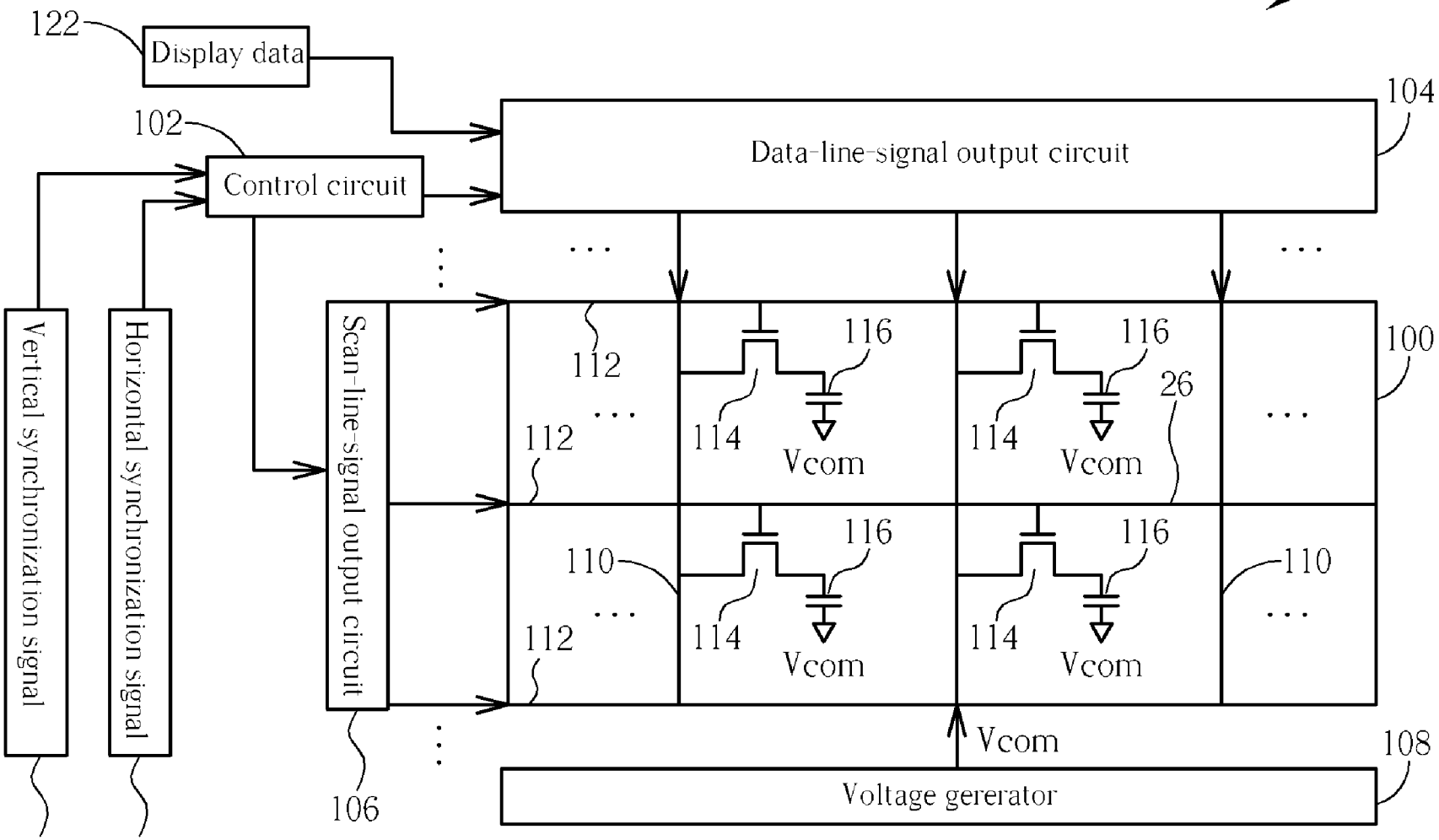
Fig. 1 Prior art
FIG. 1 is a schematic diagram of a prior art TFT LCD monitor.
Figure 2:
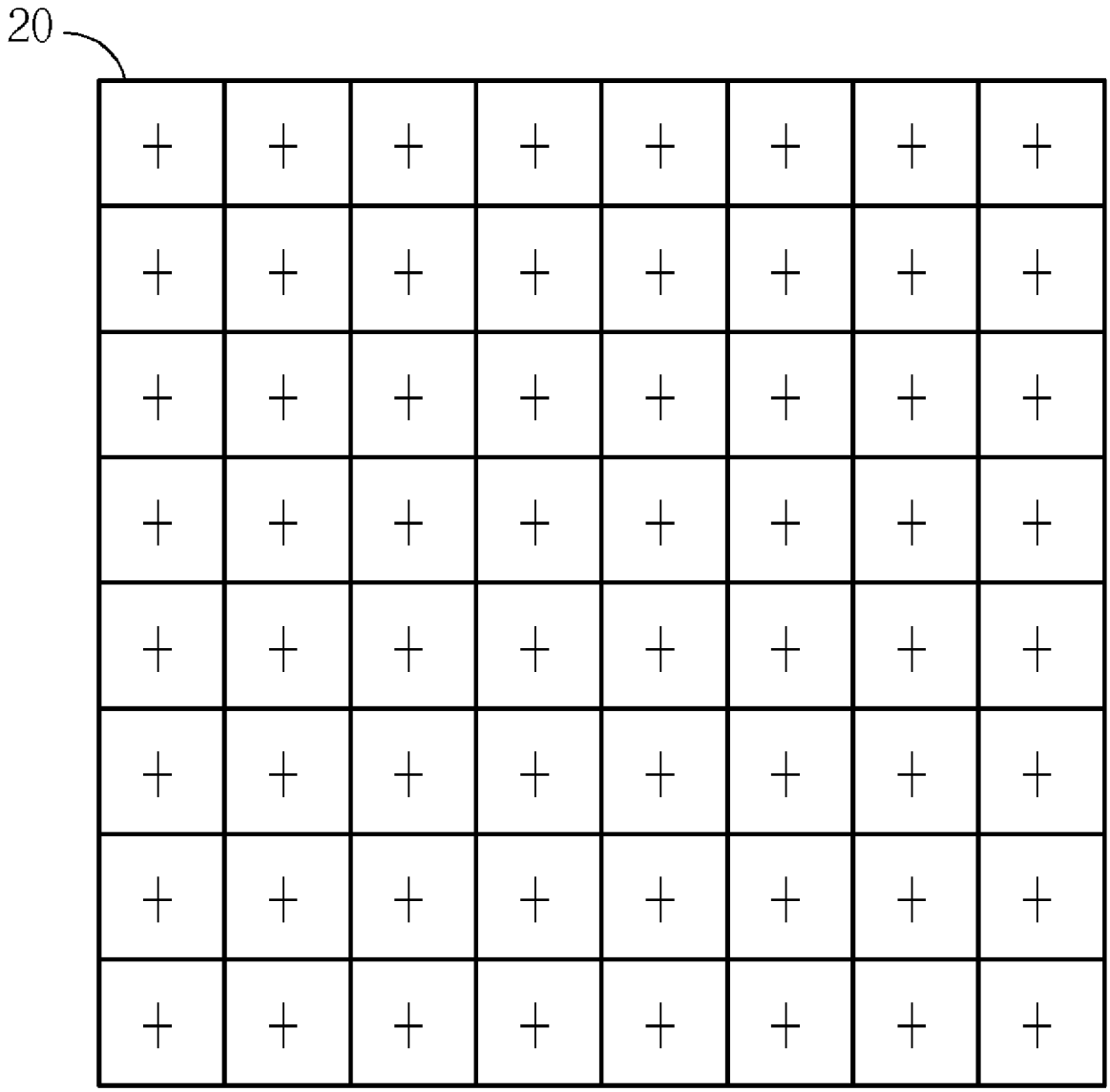
Fig. 2 Prior art
FIG. 2 and FIG. 3 are schematic diagrams of a prior art frame inversion driving method.
Figure 3:
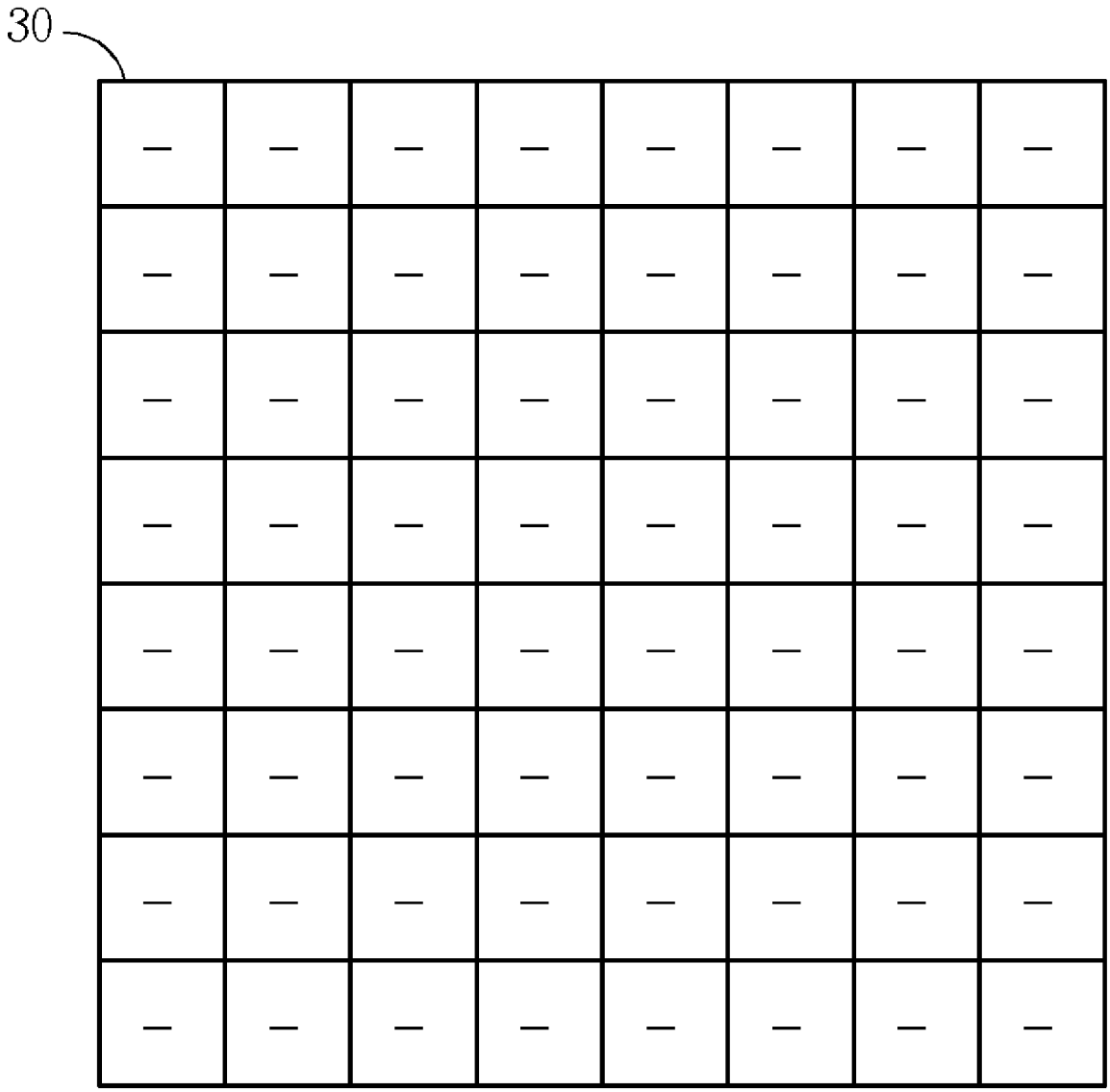
Fig. 3 Prior art
Figure 7:
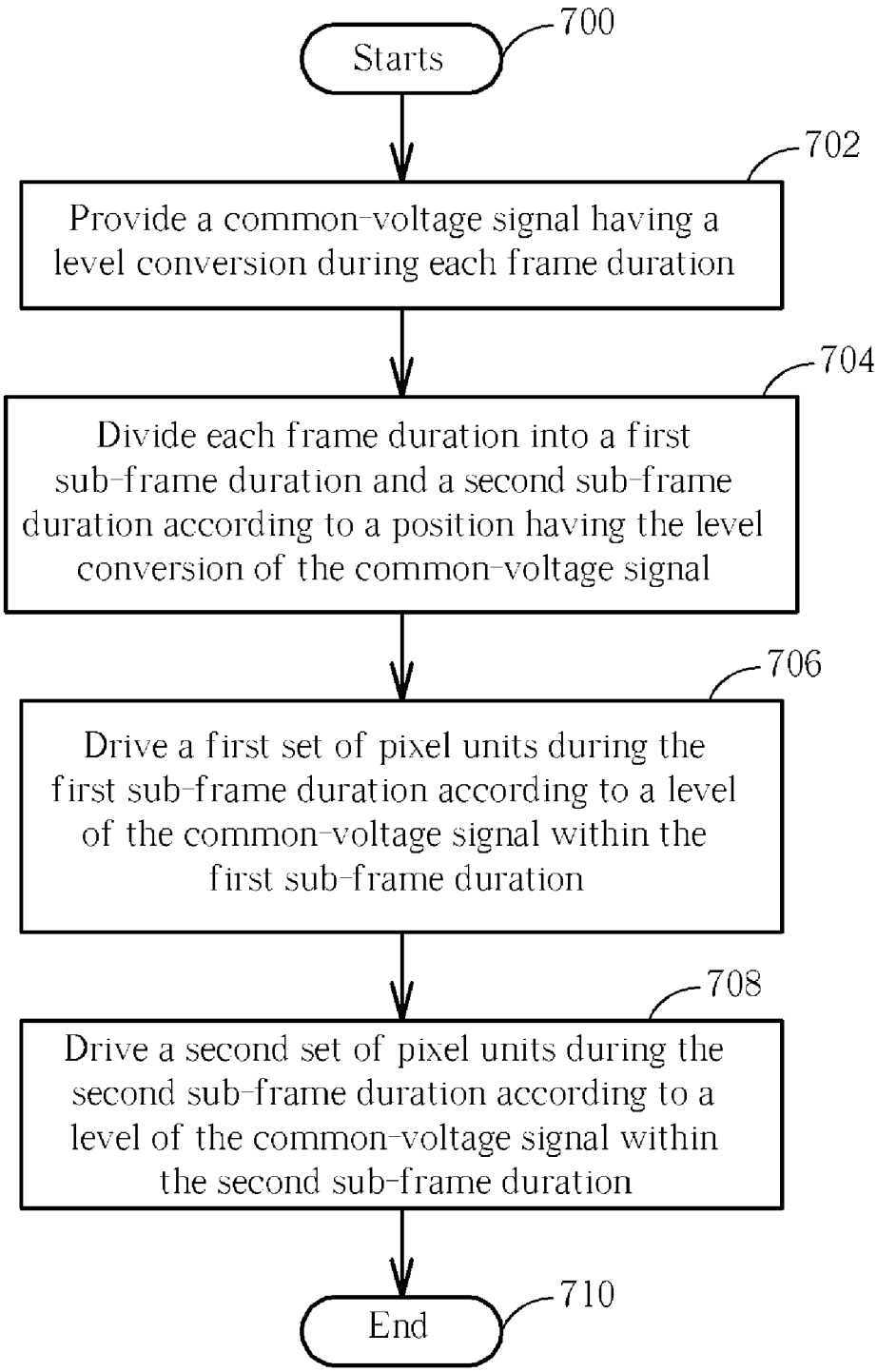
FIG. 7 is a schematic diagram of a process for driving a LCD monitor according to an embodiment of the present invention.

Please refer to FIG. 7, FIG. 7 is a schematic diagram of a process 70 for driving an LCD monitor according to an embodiment of the present invention. The LCD monitor is utilized for displaying a plurality of frame data during a plurality of frame durations. The LCD monitor can be the LCD monitor 10 shown in FIG. 1. The process 70 comprises the following steps:

Step 700: starts.

Step 702: provide a common-voltage signal having a level conversion during each frame duration.

Step 704: divide each frame duration into a first sub-frame duration and a second sub-frame duration according to a position having the level conversion of the common-voltage signal.

Step 706: drive a first set of pixel units during the first sub-frame duration according to a level of the common-voltage signal within the first sub-frame duration Step 708: drive a second set of pixel units during the second sub-frame duration according to a level of the common-voltage signal within the second sub-frame duration.

Step 710: end.

Figure 5:
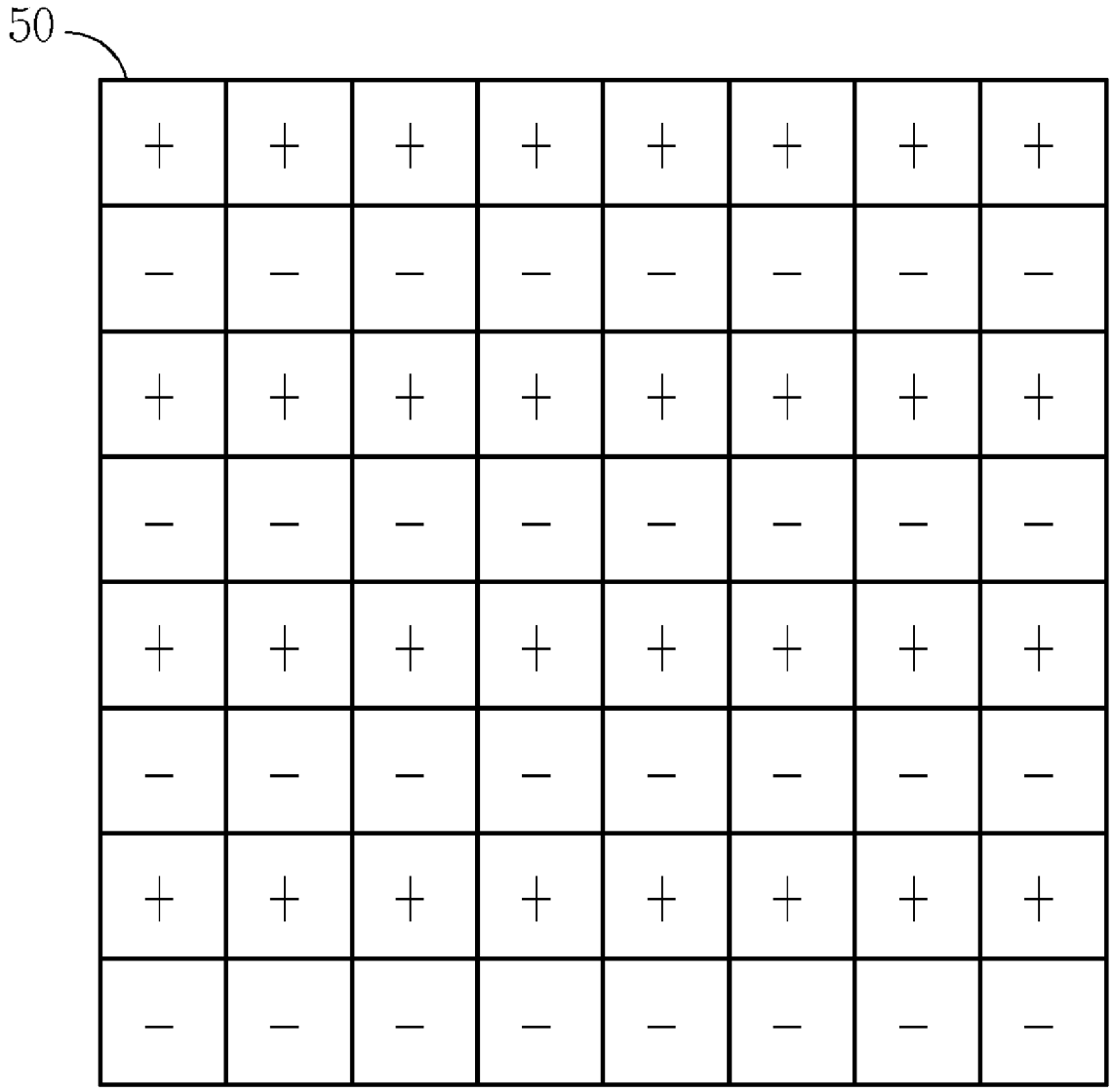
Fig. 5 Prior art
FIG. 5 and FIG. 6 are diagrams of a prior art line inversion driving method.
Figure 6:
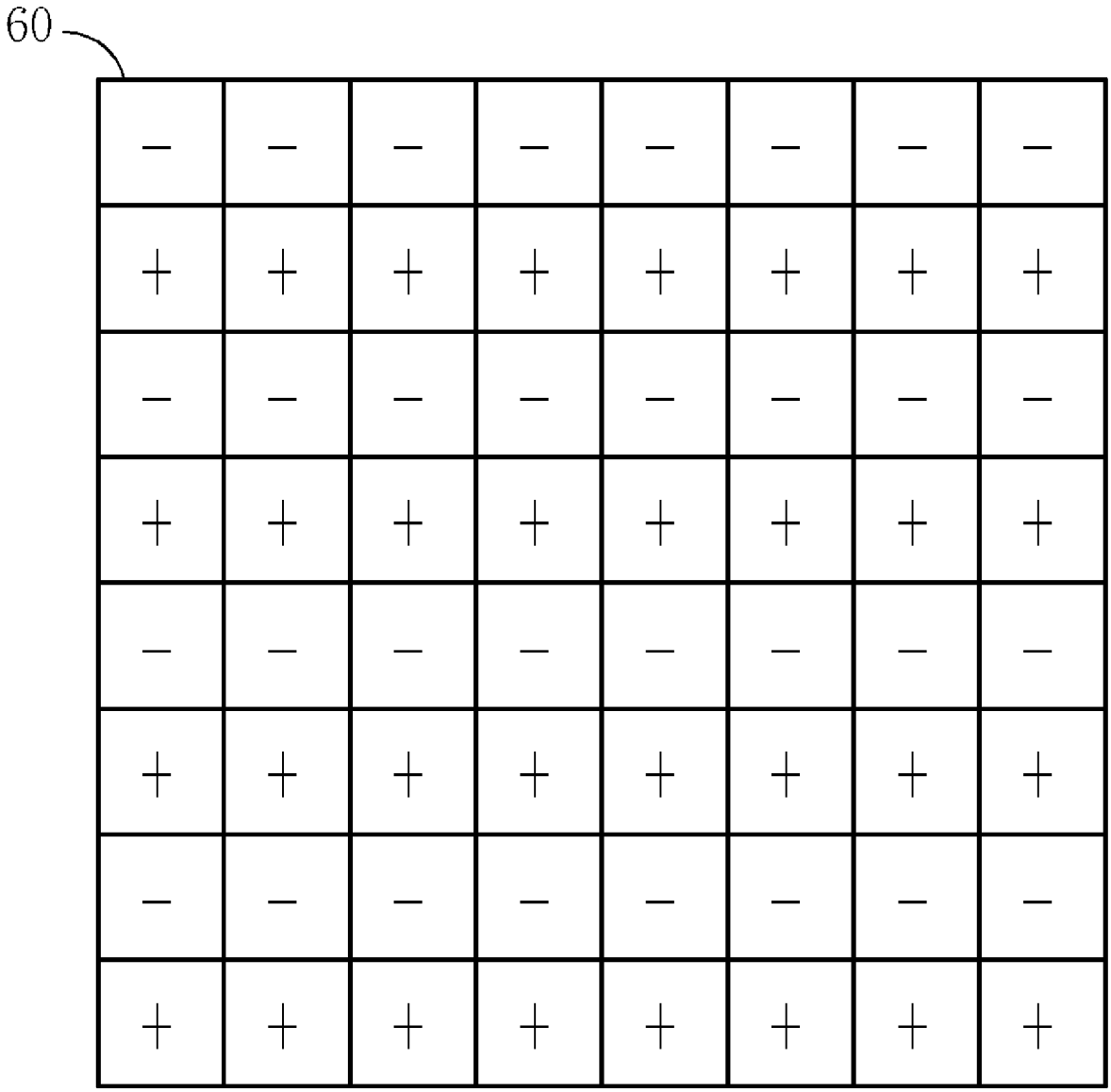
Fig. 6 Prior art
Figure 8:
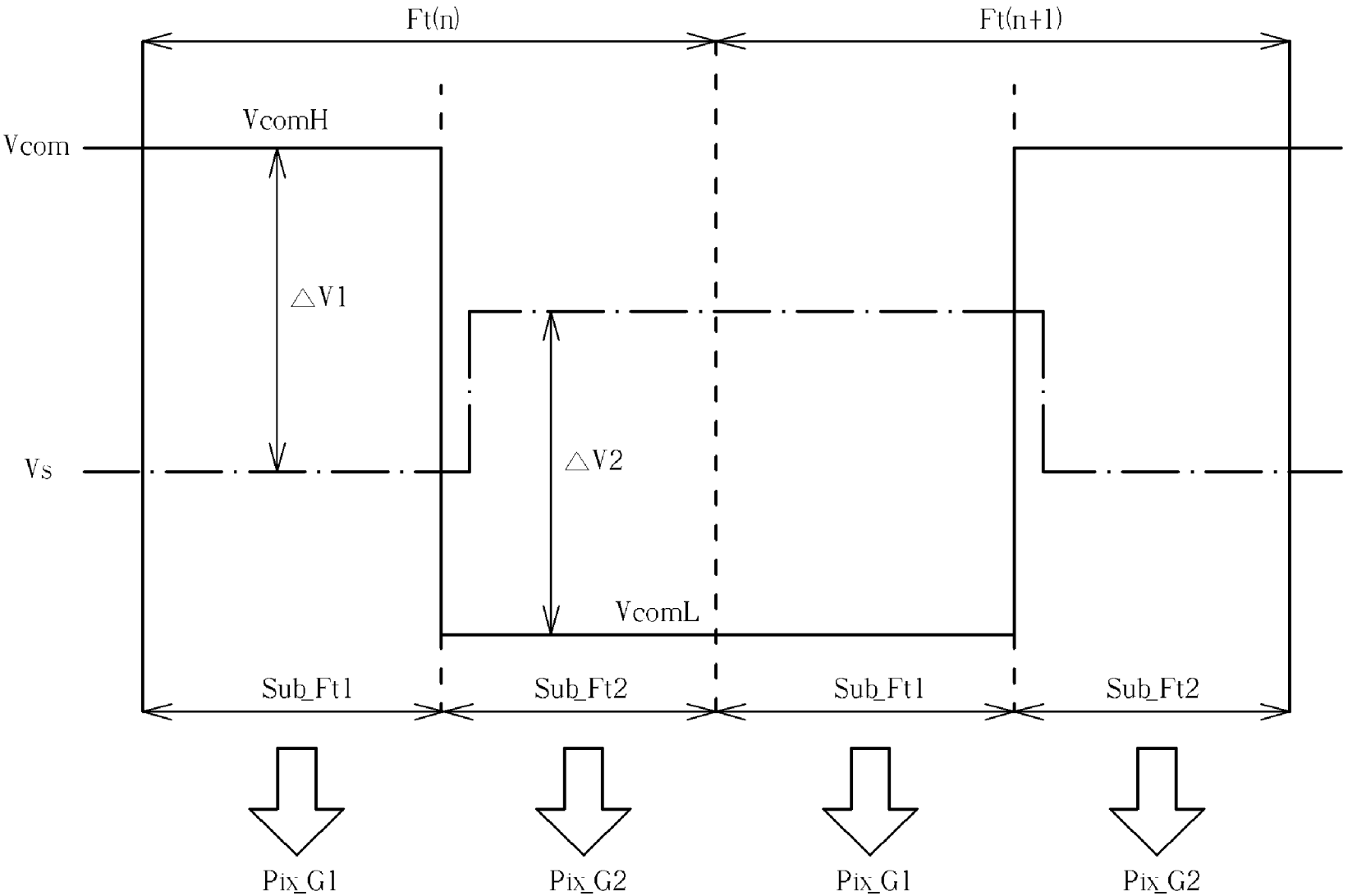
FIG. 8 is a schematic diagram of signals for driving a LCD monitor according to the process of the present invention.

According to the process 70, the common-voltage signal provided by the present invention has a level conversion during each frame duration, which divides each frame duration into a first sub-frame duration and a second sub-frame duration. The present invention drives a first set of pixel units during the first sub-frame duration and a second set of pixel units during the second sub-frame duration. Simply speaking, the present invention achieves the performance of the line inversion driving method with power consumption of the frame inversion driving method. Please refer to FIG. 8. FIG. 8 is a schematic diagram of signals for driving the LCD monitor according to the process 70. As shown in FIG. 8, the LCD monitor drives TFTs with a source driving signal Vs to display adjacent frames during adjacent frame durations Ft(n) and Ft(n+1). During each of the frame durations Ft(n) and Ft(n+1), the common-voltage signal Vcom has a level conversion (from high to low, or from low to high). According to positions having level conversions in the common-voltage signal Vcom, each of the frame durations Ft(n) and Ft(n+1) is divided into a first sub-frame duration Sub_Ft1 and a second sub-frame duration Sub_Ft2. During the first sub-frame duration Sub_Ft1, the present invention drives a first pixel unit set Pix_G1, while during the second sub-frame duration Sub_Ft2, the present invention drives a second pixel unit set Pix_G2. If the first pixel unit set Pix_G1 and the second pixel unit set Pix_G2 are respectively corresponding to odd and even horizontal lines of a panel of the LCD monitor, the LCD monitor performs as being driven by the line inversion driving method (as shown in FIG. 5 and FIG. 6).

In the prior art frame inversion driving method, the common-voltage signal has a level conversion when a frame changes. Therefore, as shown in FIG. 8, the common-voltage Vcom of the present invention can be considered advancing or delaying the sequence of the common-voltage signal utilized in the frame inversion driving method for a specific time. In other words, the present invention achieves image quality of driving methods, such as the line inversion driving method, with power consumption of the frame inversion driving method.

Figure 9:
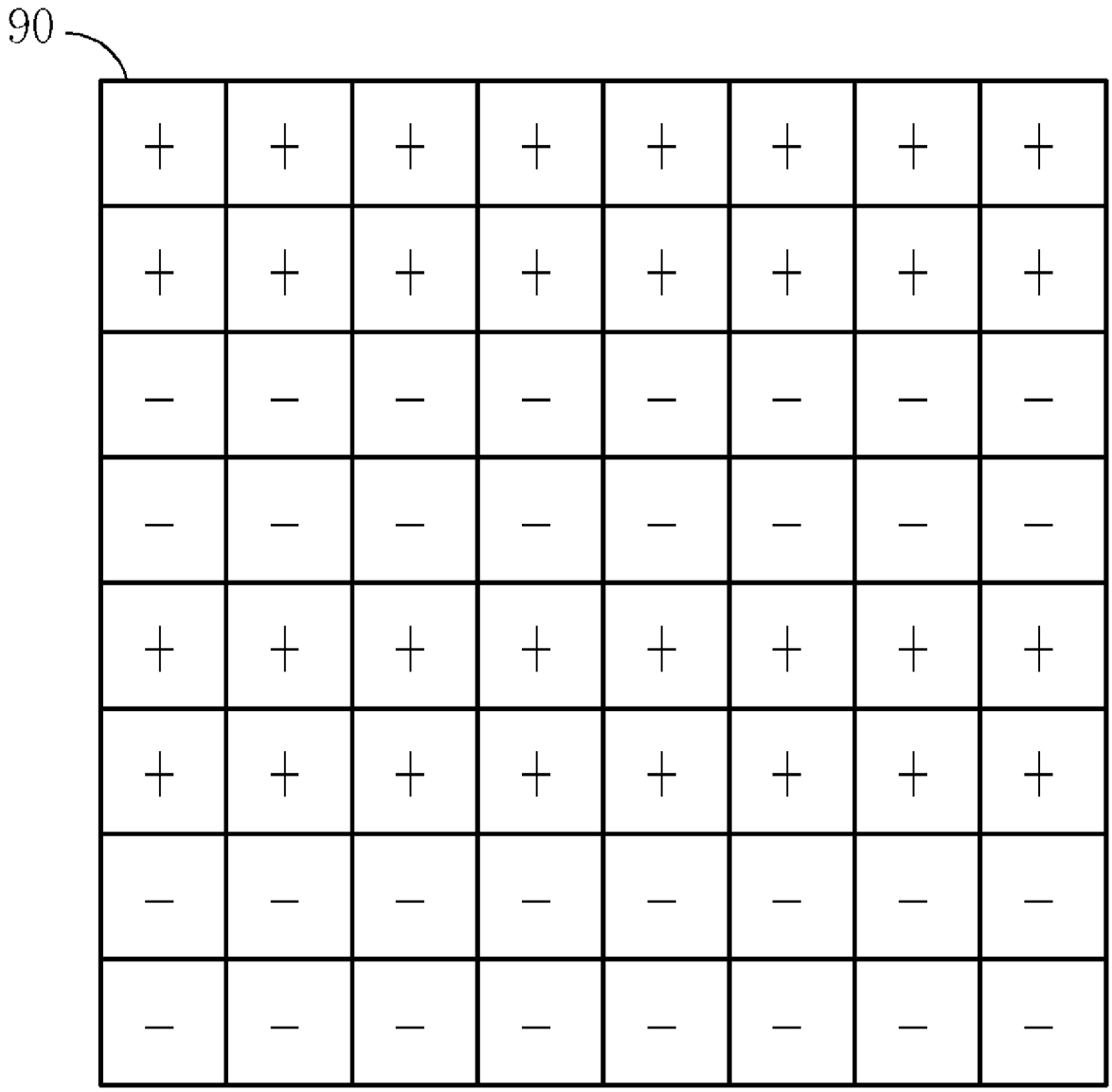
FIG. 9 and FIG. 10 are diagrams of polarity variation of the pixel units in the same part of two successive image frames.
Figure 10:
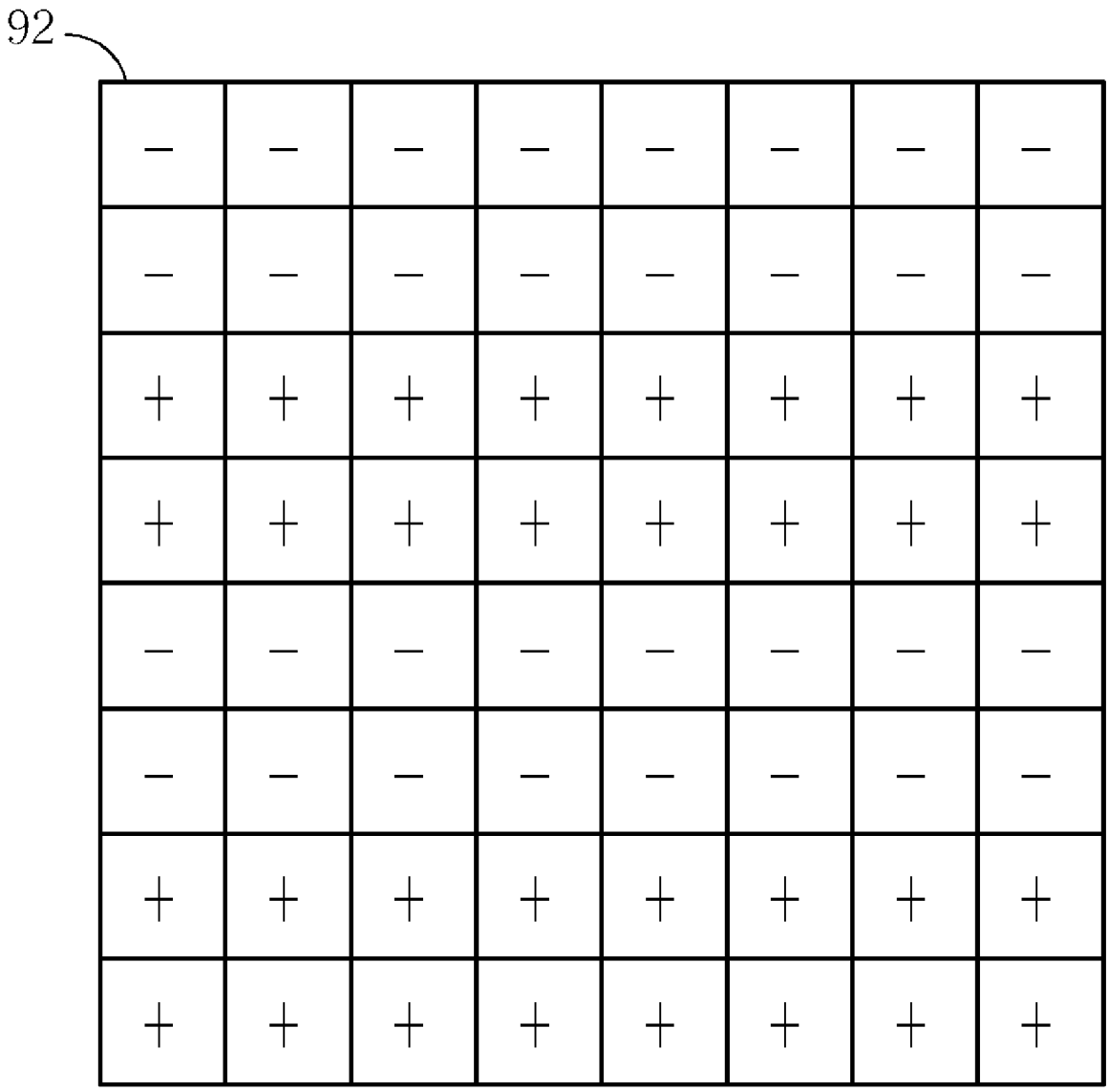

Therefore, through the process 70, the present invention divides each of the frame durations into the first sub-frame duration and the second sub-frame duration according to the position having the level conversion of the common-voltage signal in each of the frame durations. The present invention drives the first and the second sets of pixel units during the first and the second sub-frame durations respectively. Since voltage levels of the common-voltage signal during the first sub-frame duration and the second sub-frame duration are different, if polarities of the first set of pixel units are positive, then polarities of the second set of pixel units are negative. If the polarities of the first set of pixel units are negative, then the polarities of the second set of pixels are positive. Therefore, those skilled in the art can select pixel units to form the first set and the second set of pixel units, so as to achieve demanded image quality with power consumption of the frame inversion driving method. For example, if the first set of pixel units corresponds to $1^{st}$, $2^{nd}$, $5^{th}$, $6^{th}$, $9^{th}$, $10^{th}$, etc. horizontal lines of the panel, and the second set of pixel units corresponds to $3^{rd}$, $4^{th}$, $7^{th}$, $8^{th}$, $11^{th}$, $12^{th}$, etc. horizontal lines, polarity variation of the pixel units can be illustrated in FIG. 9 and FIG. 10, where blocks 90 and 92 show polarities of pixel units in same parts of two successive image frames. Comparing the blocks 90 and 92, the polarities of the pixel units in each two lines are uniform and change to opposite polarities as a frame changes.

Figure 4:
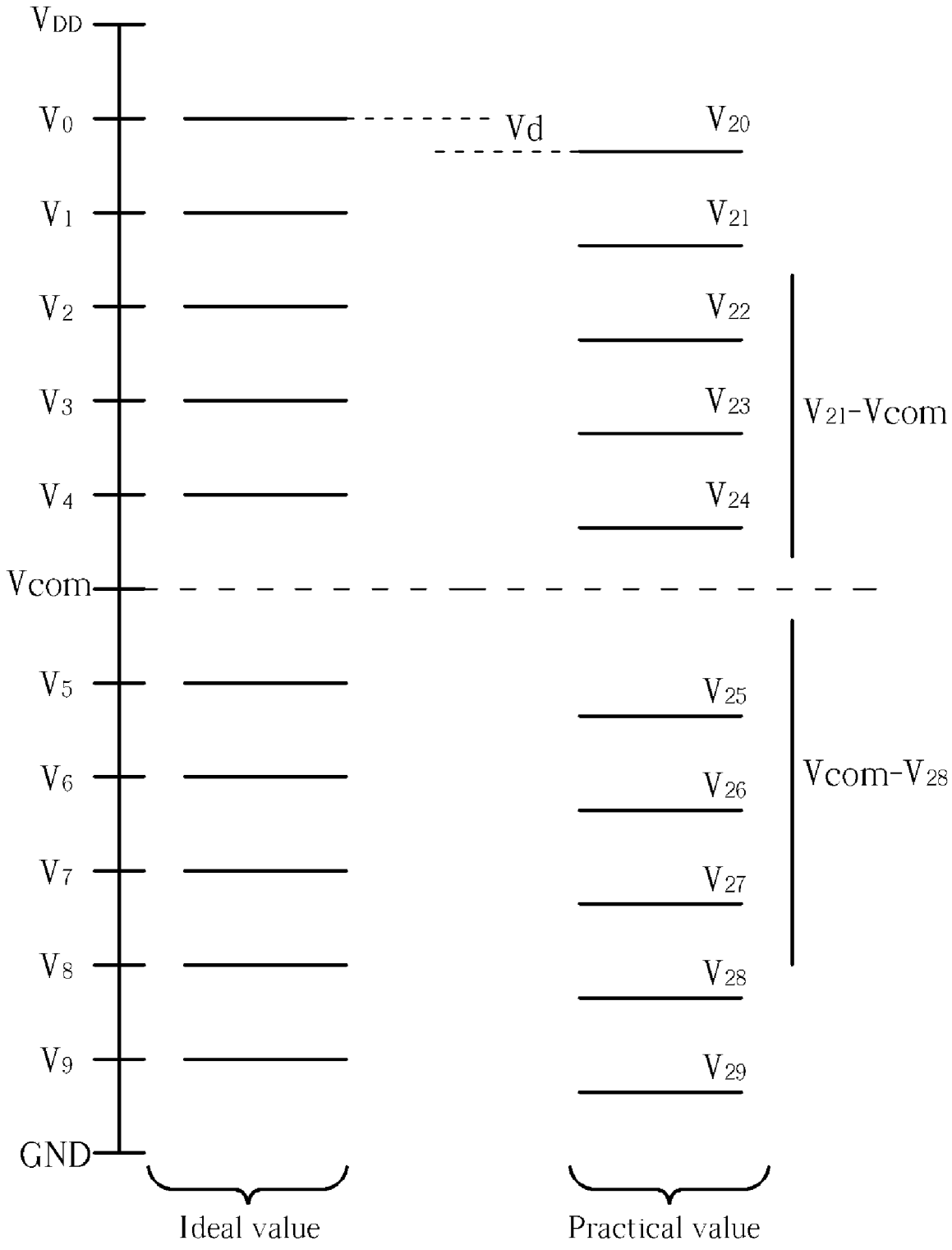
Fig. 4 Prior art
FIG. 4 is an output voltage diagram of a data-line-signal output circuit.

In addition, as shown in FIG. 4, the TFTs may be affected by elements, such as off resistances and gate-drain capacitors, so that voltages outputted to the equivalent capacitors are shifted. Thus, when pixels are driven to show images by positive and negative voltages alternatively, interlaced bright and dark lines may show in the images (if line inversion is applied) due to the voltage shifts. As shown in FIG. 8, during the first sub-frame duration Sub_Ft1 of the frame duration Ft(n), the output voltage level of the common-voltage signal Vcom is VcomH. Hence, voltage differences between two ends of liquid crystal molecules of the first pixel unit set Pix_G1 are ΔV1, and drain voltages of the TFTs are (VcomH−ΔV1). When the voltage level of the common-voltage signal Vcom changes to VcomL, the drain voltages become (VcomL−ΔV2). Ideally, ΔV1=ΔV2, or (VcomL−ΔV2)=(VcomL−ΔV1). However, owing to coupling effects of the gate-drain capacitors, charges stored in the equivalent capacitor of the liquid crystal molecules are shared by the gate-drain capacitors, so that the charges are decreased. As a result, when the drain voltages of the TFTs change from (VcomH−ΔV1) to (VcomL−ΔV1), TFT impedance becomes small as the gate-drain voltage Vgd becomes small, which increases leakage current, and changes charges stored in the equivalent capacitor. Similarly, during the first sub-frame Sub_Ft1 of the frame duration Ft(n+1), the output voltage level of the common-voltage signal Vcom is VcomL. Hence, voltage differences between two ends of the liquid crystal molecules of the first pixel unit set Pix_G1 is ΔV2, and drain voltages of the TFTs are (ΔV2+VcomL). When the common-voltage signal Vcom changes to VcomH, the drain voltage of the TFTs become (ΔV2+VcomH). Owing to coupling effects of the gate-drain capacitor Cgd, charges stored in the equivalent capacitor of the liquid crystal molecules are shared by the gate-drain capacitors, so that the charges are decreased. In this case, the voltage differences of the liquid crystal molecules in the odd and even horizontal lines are different, and thus the images include interlaced dark and bright lines.

Figure 11:
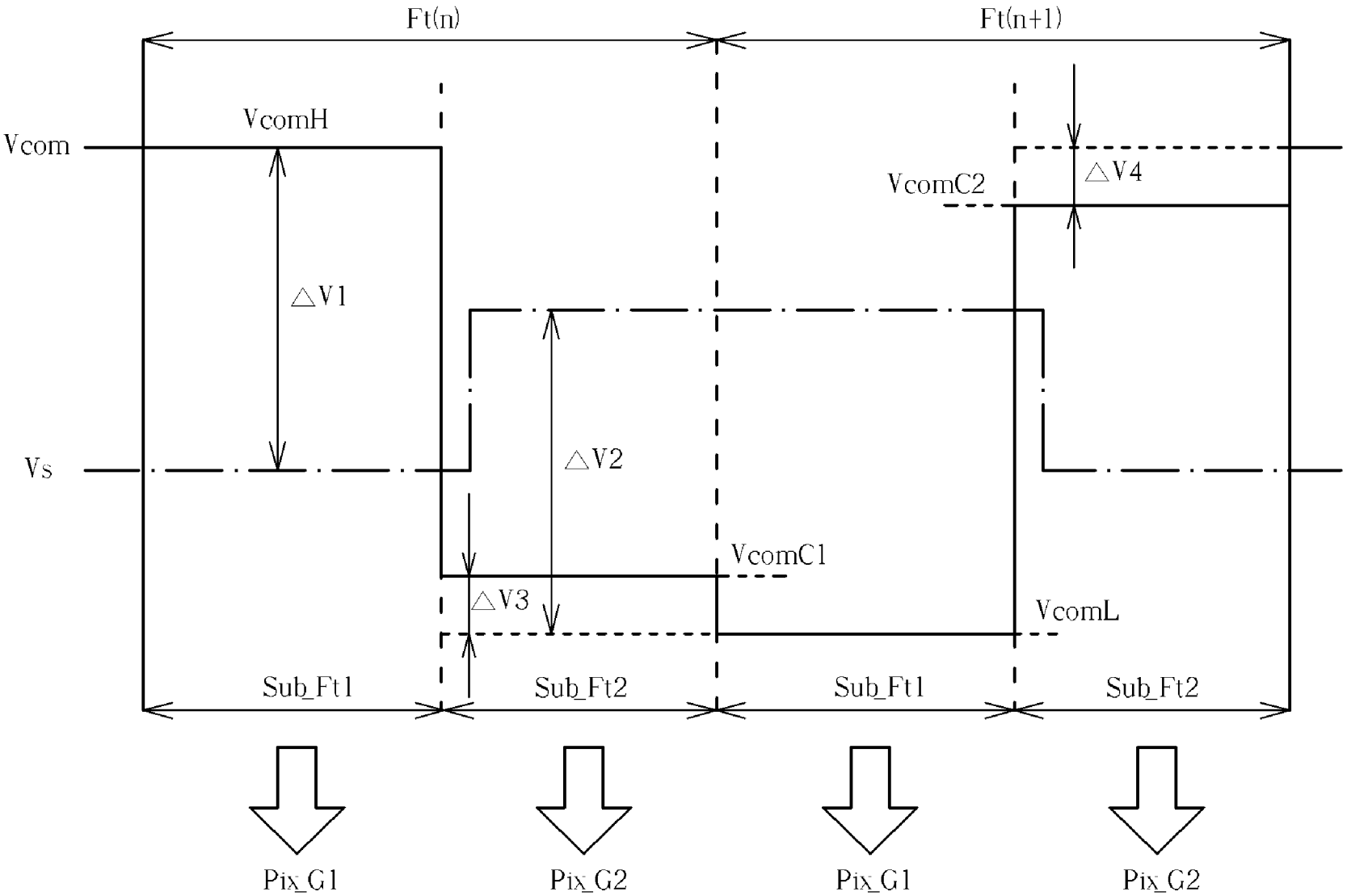
FIG. 11 is a schematic diagram of the corresponding signal for driving the LCD monitor according to the process of the present invention.

In order to improve the interlaced dark and bright lines, the present invention can further adjust the voltage level of the common-voltage signal during the second sub-frame duration according to the light intensity difference (between the first and second pixel unit sets) caused by the voltage shifts. For example, please refer to FIG. 11. FIG. 11 is a schematic diagram of signals for driving the LCD monitor according to the process 70. The embodiment shown in FIG. 11 is similar to FIG. 8, except that the present invention adjusts the voltage level of the common-voltage signal Vcom during the second sub-frame duration in FIG. 11. That is, the common-voltage signal Vcom in FIG. 8 includes two voltage levels (VcomH and VcomL), but the common-voltage signal Vcom in FIG. 11 includes four voltage levels (VcomH, VcomL, VcomC1, and VcomC2). In FIG. 11, the voltage differences of the first pixel unit set Pix_G1 are ΔV1 during the first sub-frame duration Sub_Ft1 of the frame duration Ft(n). Entering the second sub-frame duration Sub-Ft2 of the frame duration Ft(n), the voltage level of the common-voltage signal Vcom varies from VcomH to VcomC1, and the voltage differences of the second pixel unit set Pix_G2 are (ΔV2−ΔV3). During the first sub-frame duration Sub_Ft1 of the frame duration Ft(n+1), the voltage differences of the first pixel unit set Pix_G1 are ΔV2. Entering the second sub-frame duration Sub_Ft2 of the frame duration Ft(n+1), the voltage level of the common-voltage signal varies from VcomL to VcomC2, and the voltage differences of the second pixel unit set Pix_G2 are (ΔV1−ΔV4). Therefore, adjusting the voltage level of the common-voltage signal Vcom during the second sub-frame duration Sub_Ft2, the present invention can improve the dark and light lines.

Figure 12:
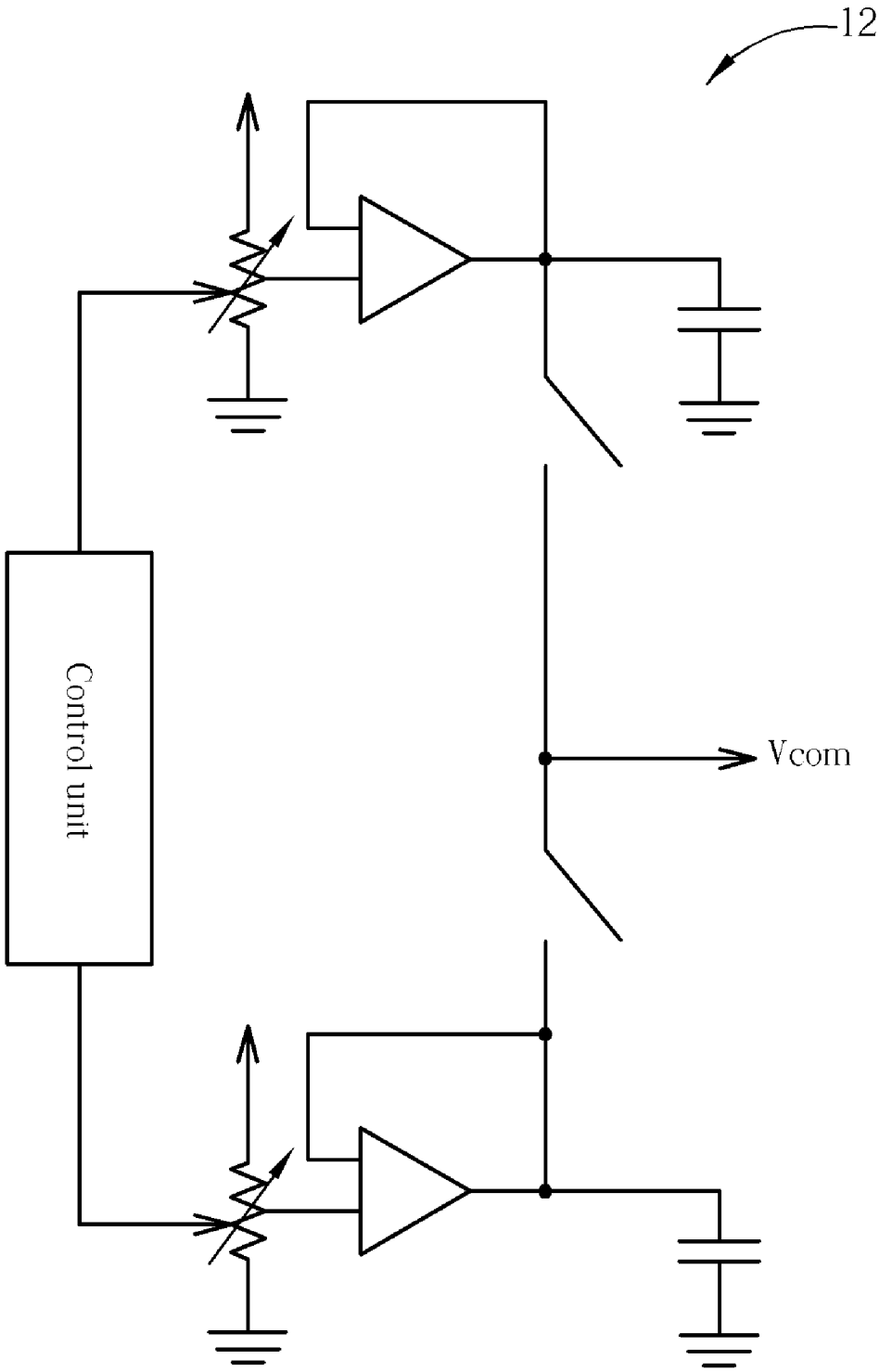
FIG. 12 is a schematic diagram of a common-voltage signal generator.

Please refer to FIG. 12; FIG. 12 is a schematic diagram of a common-voltage signal generator 12. The common-voltage signal generator 12 outputs the common-voltage signal Vcom according to a control signal generated by a control unit. The practice is well known for those who skilled in the art, and thus details will not be narrated further. Therefore, when implementing the present invention process 70, those skilled in the art can control the common-voltage signal generator 12 with the control unit, so as to output the common-voltage signal having four or more voltage levels (ex. VcomH, VcomL, VcomC1, and VcomC2), to achieve the performance of the line inversion driving method with power consumption of the frame inversion driving method, and to improve interlaced dark and light lines.

As mentioned above, the common-voltage signal provided by the present invention includes a level conversion during each frame duration, which divides a frame durations into a first sub-frame duration and a second sub-frame duration. During the first sub-frame duration, the present invention drives the first set of pixel units; while during the second sub-frame duration, the present invention drives the second set of pixel units. Therefore, setting horizontal lines corresponding to the first and second sets of pixel units, the present invention can achieve image quality of specified driving methods, such as the line inversion driving method, with power consumption of the frame inversion driving method. Furthermore, the present invention can improve the dark and light lines and enhance image quality by adjusting the voltage level of the common-voltage signal during the second sub-frame duration.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for driving a liquid crystal display (LCD) monitor for displaying a plurality of frame data during a plurality of frame durations comprising:

providing a common-voltage signal having a level conversion during each frame duration;

dividing each frame duration into a first sub-frame duration and a second sub-frame duration according to a position having the level conversion of the common-voltage signal;

driving a first set of pixel units during the first sub-frame duration according to a level of the common-voltage signal within the first sub-frame duration;

driving a second set of pixel units during the second sub-frame duration according to a level of the common-voltage signal within the second sub-frame duration, comparing brightness generated by the first set of pixel units and the second set of pixel units; and adjusting the level of the common-voltage signal during only the second sub-frame duration of each frame duration according to a brightness difference between the first set of pixel units and the second set of pixel units.

2. The method of claim 1, wherein the first set of pixel units is different from the second set of pixel units.

3. The method of claim 1, wherein the first set of pixel units is corresponding to a plurality of odd horizontal lines in a panel of the LCD monitor.

4. The method of claim 1, wherein the first set of pixel units is corresponding to a plurality of even horizontal lines in a panel of the LCD monitor.

5. The method of claim 1, wherein the first set of pixel units and the second set of pixel units are arrayed interlacedly one group by one group.

6. The method of claim 5, wherein each group is corresponding to two adjacent horizontal lines in the panel of the LCD monitor.

7. The method of claim 1, wherein the first sub-frame duration is prior to the second sub-frame duration in each frame duration.

* * * * *